US010222068B2

(12) United States Patent
Bechtold

(10) Patent No.: US 10,222,068 B2
(45) Date of Patent: Mar. 5, 2019

(54) PATIO HEATER DOUBLE DOME INFRARED HEAT REFLECTOR/CONVERTER

(76) Inventor: John Bechtold, Vista, CA (US)

( * ) Notice: Subject to any disclaimer, the term of this patent is extended or adjusted under 35 U.S.C. 154(b) by 1355 days.

(21) Appl. No.: 12/994,131

(22) PCT Filed: May 29, 2009

(86) PCT No.: PCT/US2009/045661

§ 371 (c)(1),
(2), (4) Date: Nov. 22, 2010

(87) PCT Pub. No.: WO2009/146421

PCT Pub. Date: Dec. 3, 2009

(65) Prior Publication Data

US 2011/0067694 A1 Mar. 24, 2011

Related U.S. Application Data

(60) Provisional application No. 61/130,292, filed on May 29, 2008.

(51) Int. Cl.
*F24C 1/12* (2006.01)

(52) U.S. Cl.
CPC ..... *F24C 1/12* (2013.01)

(58) Field of Classification Search
CPC .. F24C 3/042; F24C 3/04; F24C 7/065; F24C 15/22; F24B 1/181
USPC ..... 126/92 B, 92 AC, 92 R, 91 R, 519, 85 R
See application file for complete search history.

(56) References Cited

U.S. PATENT DOCUMENTS

| | | | | |
|---|---|---|---|---|
| 910,345 | A | 1/1909 | Akin | |
| 3,401,258 | A * | 9/1968 | Guth | 362/349 |
| 6,102,031 | A * | 8/2000 | Waters | 126/92 AC |
| 6,668,818 | B2 * | 12/2003 | Bossler | 126/92 AC |
| 6,745,759 | B2 * | 6/2004 | Bossler | 126/92 B |
| 2003/0056783 | A1 | 3/2003 | Bossler | 126/92 |

FOREIGN PATENT DOCUMENTS

| | | | |
|---|---|---|---|
| WO | WO 2007000076 | 4/2007 | F24H 3/04 |

OTHER PUBLICATIONS

WIPO Written Opinion dated Nov. 30, 2010.

* cited by examiner

*Primary Examiner* — Avinash Savani
(74) *Attorney, Agent, or Firm* — Steins & Associates, P.C.

(57) ABSTRACT

A Patio Heater Double Dome Infrared Heat Reflector/Converter is disclosed. The patio heater dome attachment is attachable to a conventional patio heater so that the dome attachment covers the heater's heat shield, while maintaining an air gap therebetween. There are preferably standoff ridges or other features built into the dome attachment to maintain this air gap and to prevent air from flowing freely between the heat shield and the dome attachment. The dome attachment embodies a very low heat load so that very little heat conduction occurs between the heat shield and the dome attachment, such that more of the heater's energy is reflected towards the usage area. Finally, the perimeter edge of the dome attachment extends downwardly at least until it is essentially horizontally planar with the perimeter edge of the patio heater heat shield.

19 Claims, 8 Drawing Sheets

A - A

B - B

C - C

D - D

E - E

F - F

PATIO HEATER DOUBLE DOME INFRARED HEAT REFLECTOR/CONVERTER

This application claims priority to Provisional Application Ser. No. 61/130,292, filed May 28, 2008, and is the National Stage filing of subsequent PCT Request Serial Number PCT/US09/45661, filed May 29, 2009 (within one year of said '292 Provisional Application).

BACKGROUND OF THE INVENTION

1. Field of the Invention

This invention relates generally to outdoor patio heating devices and, more specifically, to a Patio Heater Double Dome Infrared Heat Reflector/Converter.

2. Description of Related Art

Propane-fueled heaters are prevalent for heating outdoor spaces. Many restaurants and taverns provide the heaters to heat outdoor serving areas in the evenings. The typical heater used in such hospitality environments are large units that utilize a five gallon propane cylinder for fuel, although the same issue discussed herein applies to Natural Gas-fueled and Electric heaters. Residential use of these "patio" heaters has grown over the years, with a smaller, table-top version being created that is ideal for the home application. Except for scale/size, the elements of the table-top unit are essentially comparable to the full-size models. FIG. 1 is a perspective view of a conventional (table-top) patio heater 10.

The patio heater 10 has a base 12, within which the propane cylinder is contained. A stem 14 extends upwardly from the base 12 to the burner 16. The propane flow passes through the stem 14 to supply the burner 16 with fuel. Presumably for safety reasons, the burner 16 is topped by a heat shield 18, and often surrounded by a guard 20. The heat shield 18 is defined by a circular (typically) perimeter edge 24, and is removably attached to the burner 16 by a securing nut 22 (or by some other fastening system).

While the conventional patio heater 10 is very handy to increase personal comfort while entertaining or otherwise spending time outdoors, it does suffer from problems related to inefficiency (large fuel consumption) and environmental problems related to the combustion of the fuel. While there are heaters available that use a fixed fuel source (such a natural gas), rather than a self-contained propane tank, most heaters 10 employ a portable source. Table-top units are generally too small to have a piped-in is fuel source, and the piping would harm the utility of even having a table-top unit. With large models, the portability of the heater is lost if a permanent piped fuel source is used.

For these reasons, an integrated tank is by far the most useful version of the patio heater 10. The drawback of the tank version is that there is a finite amount of available fuel. As a result, any way to increase efficiency of the heater 10 and/or burner 16 will extend the lifespan of the fuel in a tank, and therefore reduce the number of tank exchanges. Furthermore, by increasing efficiency and by reducing fuel consumption, it is expected that the environmental concerns associated with the increasing numbers of active propane-fueled heaters would be lessened.

SUMMARY OF THE INVENTION

In light of the aforementioned problems associated with the prior attachments and devices, it is an object of the present invention to provide a Patio Heater Double Dome Infrared Heat Reflector/Converter. The patio heater dome attachment should be attachable to a conventional patio heater so that the dome attachment covers the heater's heat shield, while maintaining an air gap therebetween. There should be standoff ridges or other features built into the dome attachment to maintain this air gap between the heat shield and the dome attachment and to keep air from flowing through freely. The dome attachment should embody a very low heat load so that very little heat conduction occurs m between the heat shield and the dome attachment, such that heater energy typically lost to the air above the heater is reflected back and radiated to the burner area, and ultimately towards the usage area as radiant heat. Finally, the perimeter edge of the dome attachment should extend downwardly at least until it is essentially horizontally planar with the perimeter edge of the patio heater heat shield.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Patio Heater Double Dome Infrared Heat Reflector/Converter.

Figure 1:
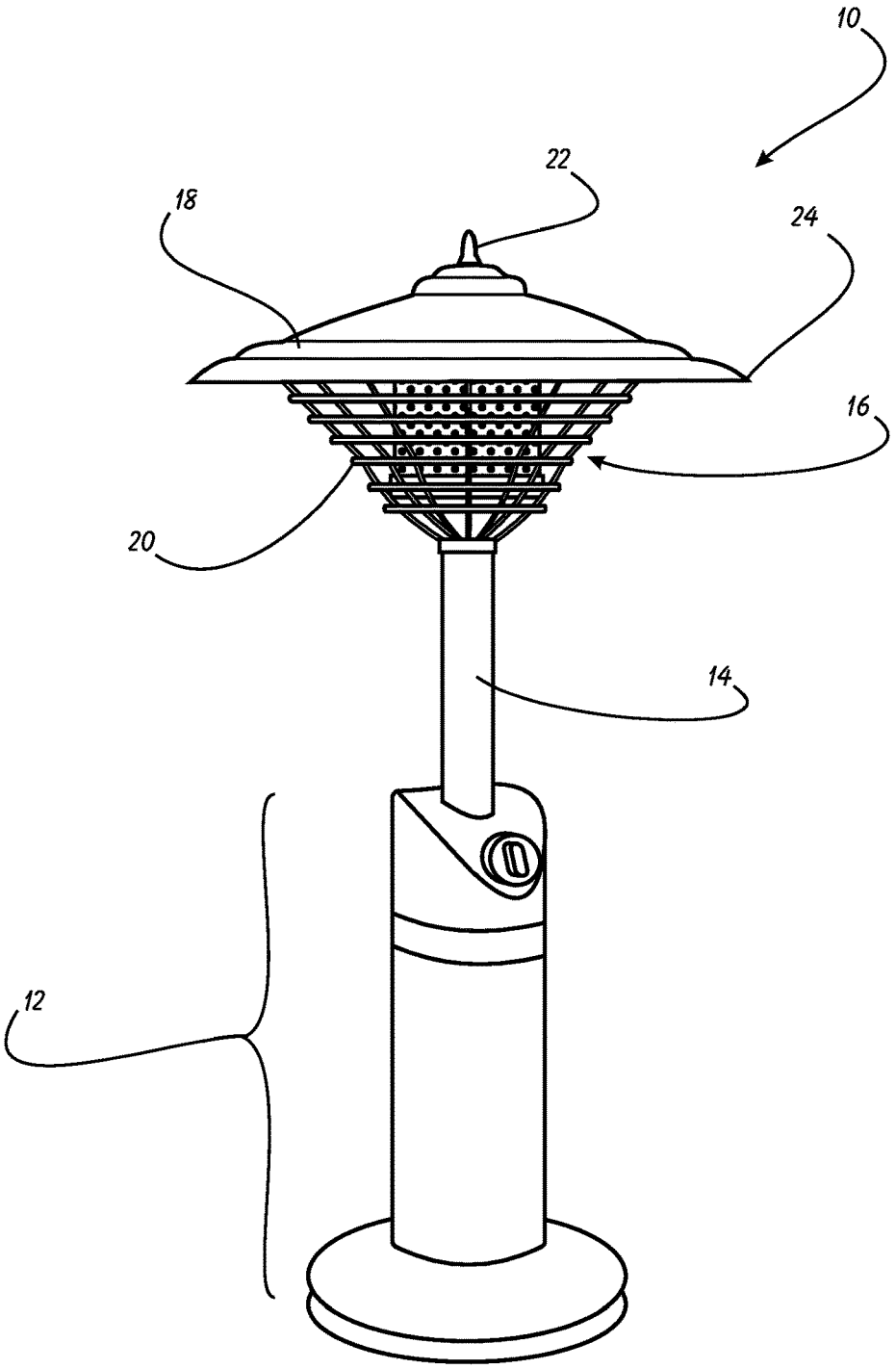
FIGURE 1 PRIOR ART
FIG. 1 is a perspective view of a conventional patio heater.
Figure 2:
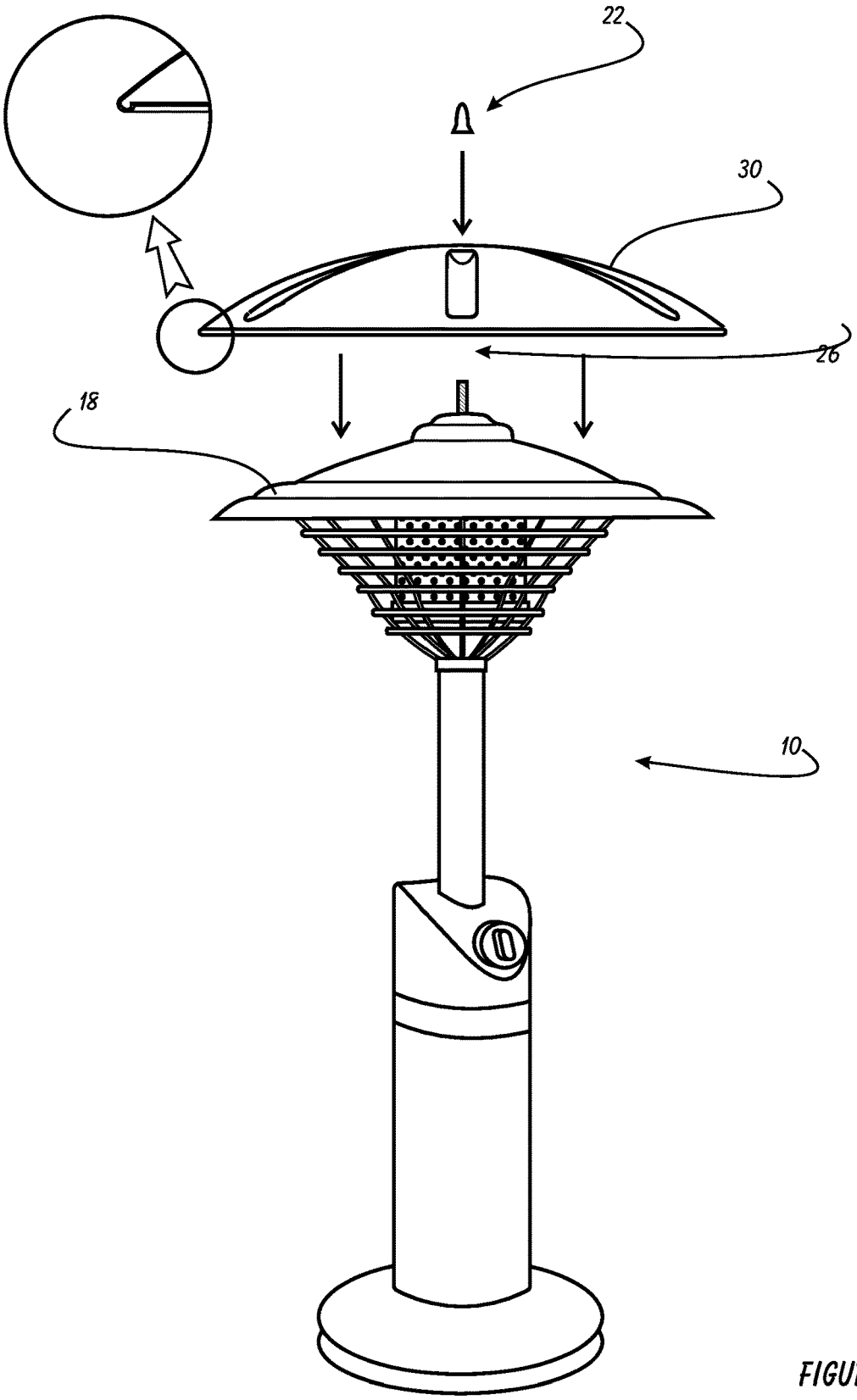
FIG. 2 is a partially exploded perspective view of a preferred embodiment of the present invention being attached to the heater of FIG. 1.

The present invention can best be understood by initial consideration of FIG. 2. FIG. 2 is a partially exploded perspective view of a preferred embodiment of the present invention 30 being attached to the heater 10 of FIG. 1. The double dome attachment 30 is a secondary member designed to fit do sely above and over the heat shield 18 of the heater 10. In the depicted heater 10 model, the securing nut 22 is unscrewed from the securing stud 26, and the attachment 30 is then placed over the stud 26 and the nut 22 is reattached.

It is known that certain patio heater manufacturers and models use a variety of bolt arrangements for securing the heat shield 18 to the heater 10. For example, one prior model uses three studs, rather than one. These different bolt/stud arrangements are accommodated by the present invention in a couple of ways. First, the dome attachment 30 is provided with a number of apertures pre-formed in the center area of the dome attachment. Second, the user has instructions regarding forming custom apertures in the double dome attachment 30, for those cases where the pre-formed apertures fail to align with their heater 10 model.

On another point, the double dome attachment 30 is available in a variety of shapes (circular, square, etc.) and sizes (small, medium, large) so that virtually all conceivable versions of patio heater 10 available on the market today and in the future could be accommodated.

Figure 3:
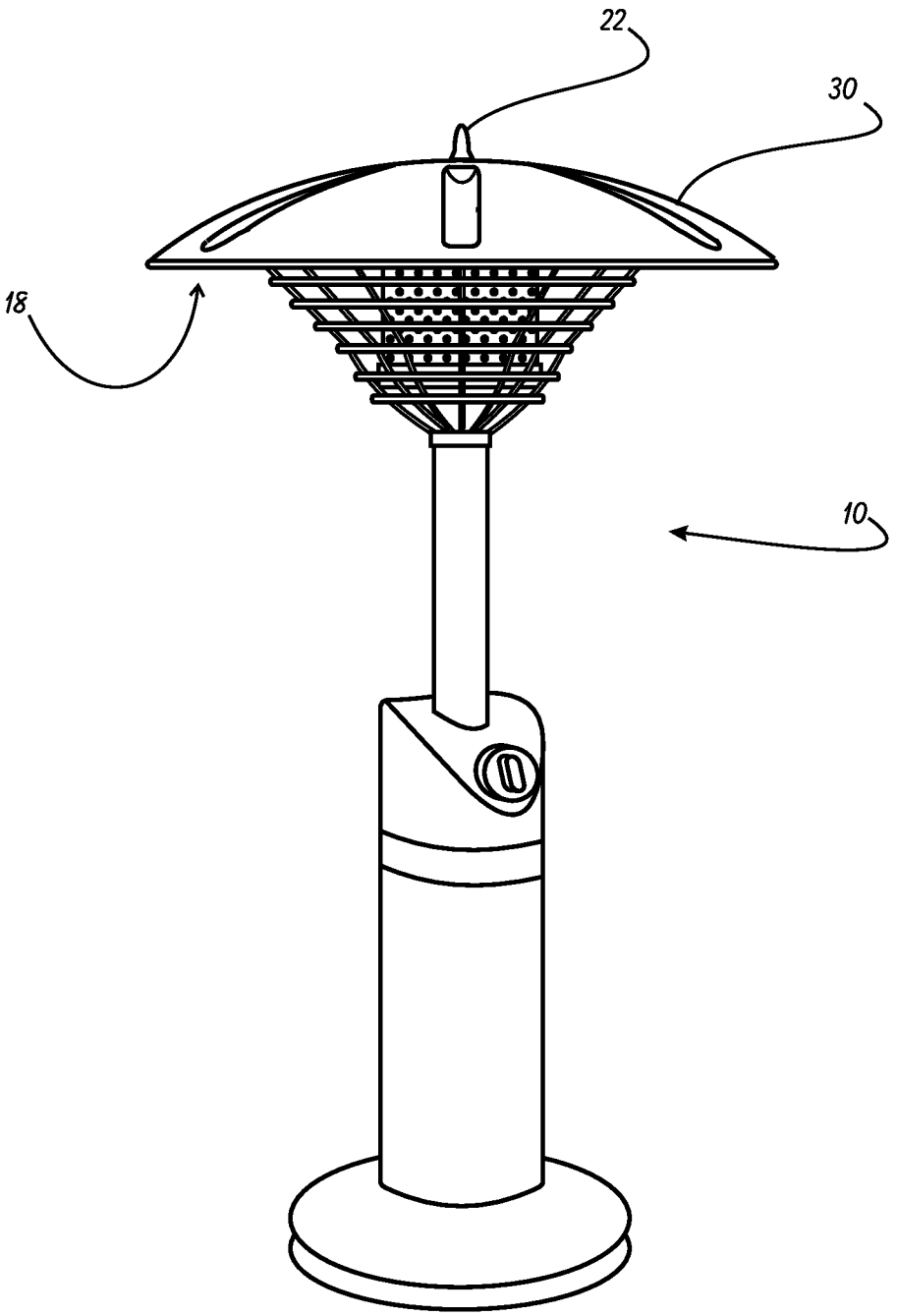
FIG. 3 is a perspective view of the attachment and heater of FIGS. 1 and 2.

If we now turn to FIG. 3, we can see how the heater 10 and double dome attachment 30 appear as a combination. FIG. 3 is a perspective view of the attachment 30 and heater 10 of FIGS. 1 and 2. As can be seen, once secured by the securing nut 22, the double dome attachment 30 completely covers the original equipment heat shield 18. In this position, the attachment 30 is found to collect, reflect and re-radiate a substantial amount of heat energy that is radiated and convected upwardly from the heat shield.

Figure 4:
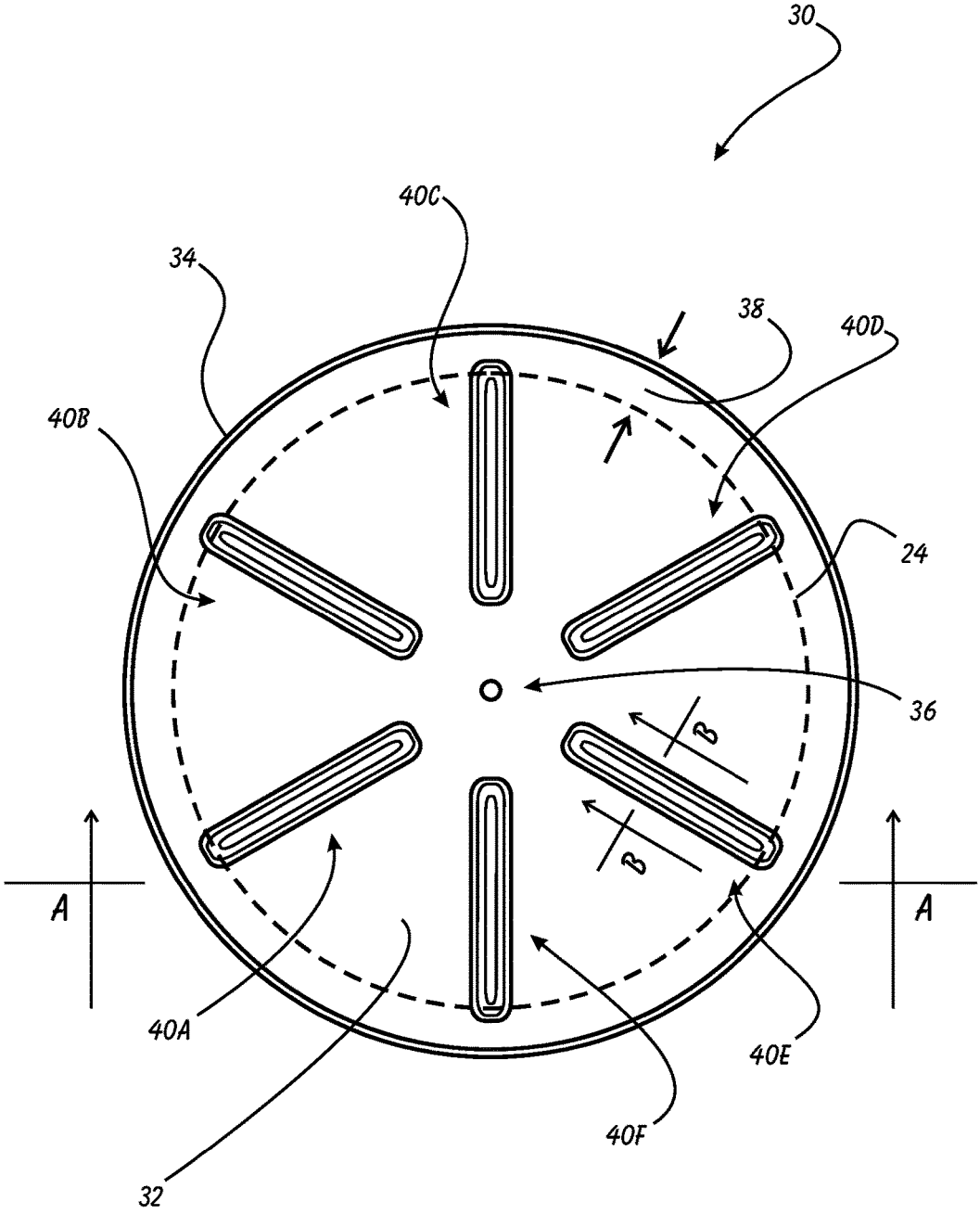
FIG. 4 is a top view of the attachment of FIGS. 2 and 3.

FIG. 4 provides additional design details of the present invention. FIG. 4 is a top view of the attachment 30 of FIGS. 2 and 3. In its simplest form, the dome member 32 is made from a very thin sheet of aluminum material. The purpose of using very thin material is to minimize the thermal mass of the attachment 30. If the thermal mass is very low, then the attachment 30 will reflect and radiate energy without retaining as much heat, thereby creating another radiant heat source. Much of the captured heat energy is returned to the radiant element, thereby increasing the heat radiating from the element as well as from the heat shield (see FIG. 1).

Durability or aesthetic qualities can also be enhanced by utilizing a multi-layered material for the dome member 32. A multiple layered material will tend to be more rigid than a single thin layer of material, and will provide decorative options, such as the ability to emboss logos and other designs into the member 32. While such options are available in a limited fashion in the single-layer version of dome member 32, there would be additional options for the multi-layered type.

The dome member 32 should be somewhat larger than the heat shield (see FIG. 1) so that rising heat from combustion gases will be captured. It is preferable that there be approximately two (2) centimeters air gap between the heat shield and the dome member 32. The overhang 38 between the double dome member's 32 perimeter edge 34 and the heat shield perimeter edge 24 (shown in dashed lines) should be such that the dome member 32 extends downwardly until its perimeter edge 34 is at least even (in a horizontal plane) with the heat shield perimeter edge 24. As discussed previously, a central aperture 36 is provided for accepting the patio heater's securing stud therethrough. In the event that the aperture 36 is not needed, a cap may be provided to the user in order to cover the aperture 36.

In order to maximize the efficiency of the attachment 30, there must be a slight gap between the top of the heat shield and the bottom of the attachment 30 is (discussed above as being approximately 2 centimeters). This gap is created by elements extending downward from the bottom surface of the dome member 32. In the depicted version, these spacer elements are standoff ridges 40A-40F. Each standoff ridge 40A-40F is a crimped portion in the dome member 32 that rests against the top of the heat shield and maintains an air gap between the dome member and the heat shield with only a minimal amount of physical contact (in order to minimize conduction). The lower end feature of the stand-off ridge (e.g. 40A) design is a portion of a truncated cone shape, rather than a radius, in order to allow water and other debris to escape. Here, there are six standoff ridges 40A-40F; in other versions, either more or fewer ridges 40A-40F might be provided.

The standoff ridge 40A design is only one simple type of structure that might be provided by the attachment 30 in order to maintain the proper spacing between the heat shield and the attachment 30. Clips, brackets, pegs or other apparatus might also alternatively be used.

Figure 5:
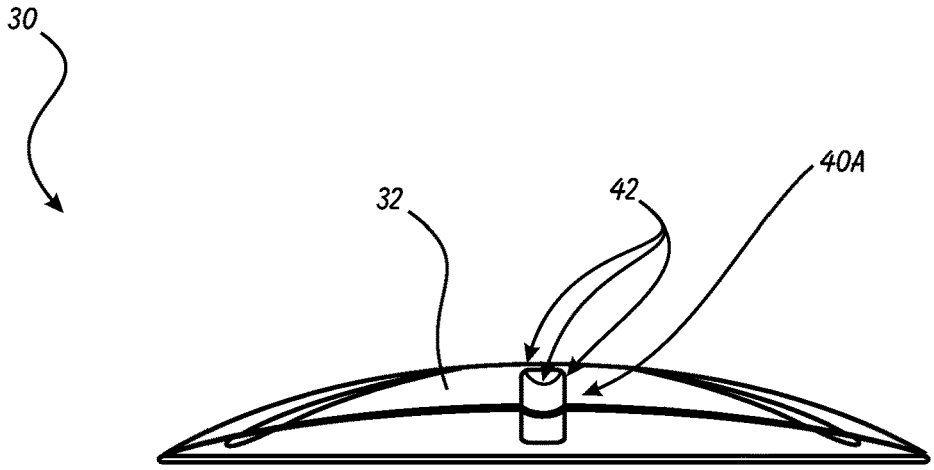
FIG. 5 is a partially cutaway side view of the attachment of FIGS. 2, 3 and 4.
Figure 6:
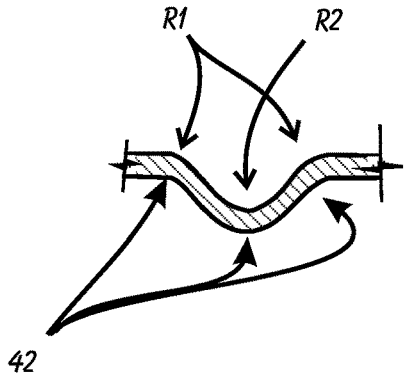
FIG. 6 is a cutaway side view of the standoff ridge of FIGS. 2-5.

Finally, we turn to FIGS. 5 and 6 to examine the standoff ridge detail more closely. FIG. 5 is a partially cutaway side view of the attachment 30 of FIGS. 2, 3 and 4. FIG. 6 is a cutaway view of standoff ridge 40E.

As mentioned, the standoff ridge 40E is formed by a plurality of bends 42 stamped or otherwise formed into the dome member 32. The bends 42 are defined by radii R1 and R2. While R1 and R2 could be different for different dome 30 designs, in the instant example, they are the same as one another. Here, both R1 and R2 are 0.5 (one-half) inch in order to form a smooth, ridge 40E.

The ridge 40E will therefore be contoured to match the parabolic or spherical shape of the dome member 32 so that is closely mirrors the shape of the heat shield. While it has been observed that virtually all heat shields are based on these shapes, in the event that other shapes are available or enter the market, the intent would be to provide a double dome attachment 30 that matches the profile of that new shape. Also, the material chosen for the dome member 32 is selected to be a type that can be formed by the user so that it will mirror the shape of the heat shield (see FIG. 1) (and perhaps even be formed or trimmed to fit by the end user).

Table I below displays test data for a of conventional 40,000 BTU patio heater before and after installation of the double dome attachment 30 of the present invention. Table II below displays the burner and collector temperatures by Gas Consumption with and without the double dome attachment 30 installed.

*Please note that all possible care has been taken to keep measurements precise and variables controlled. Tests were conducted using a standard "Endless Summer"(Trademark) 40,000 BTU Patio Heater under calm conditions @58 degrees Fahrenheit ambient temperature.

These tests were performed with a prototype Double Dome and Heat Director made of unpolished 0.025" aluminum sheet. Thinner and/or more reflective aluminum perform more effectively.

Percentage of Fuel Savings @ Highest Stock Temperatures**

| Measurements in Degrees Fahrenheit | Stock | With Double Dome | % of Gas Savings W/Dome at stock temperature. |
|---|---|---|---|
| Radiant Collector @ 32" | 135 | 166 | 29% |

-continued

| Percentage of Fuel Savings @ Highest Stock Temperatures** | | | |
|---|---|---|---|
| Measurements in Degrees Fahrenheit | Stock | With Double Dome | % of Gas Savings W/Dome at stock temperature. |
| Top of Burner Holder | 782 | 906 | 34% |

**Gas Savings are computed by drawing a horizontal line across the graph from the highest stock temperature at maximum consumption temperature on the line with the device installed. Divide the gas consumption at that temperature, using that device stock by 6.5 (the maximum gas consumption at that temperature) to obtain the percentage of "stock" consumption at that temperature, using that device. 100% − Percentage Consumed = Percentage Saved. See notes below for the calculations.

Math Notes:

Percentage of Fuel Saved by Temperatures @ the radiant collector:

% of Gas Savings W/Dome 4.6 (0.046 $m^3$ per minute)/6.5 (0.065 $m^3$ per minute) = 71% consumption, 100% − 71% = 29% Fuel Savings Percentage of Fuel Saved by Temperatures @ the Top of the Burner Holder:

% of Gas Savings W/Dome 4.3(0.043 $m^3$ per minute)/6.5 (0.065 $m^3$ per minute) = 66% consumption 100% − 66% = 34% Fuel Savings As shown here, the heater actually produced a significantly higher temperature after installation of the double dome attachment 30 at both high and low settings. The user can choose to throttle back the fuel flow to the heater by twenty-five to thirty percent, and still enjoy the same radiant heat output to the area of use as an unmodified heater that is not so throttled back. Consequently, the fuel tank will be expected to last twenty-five to thirty percent longer than the prior standard heater, and will provide the environmental benefits of less fuel consumed and less carbon emissions.

Figure 7:
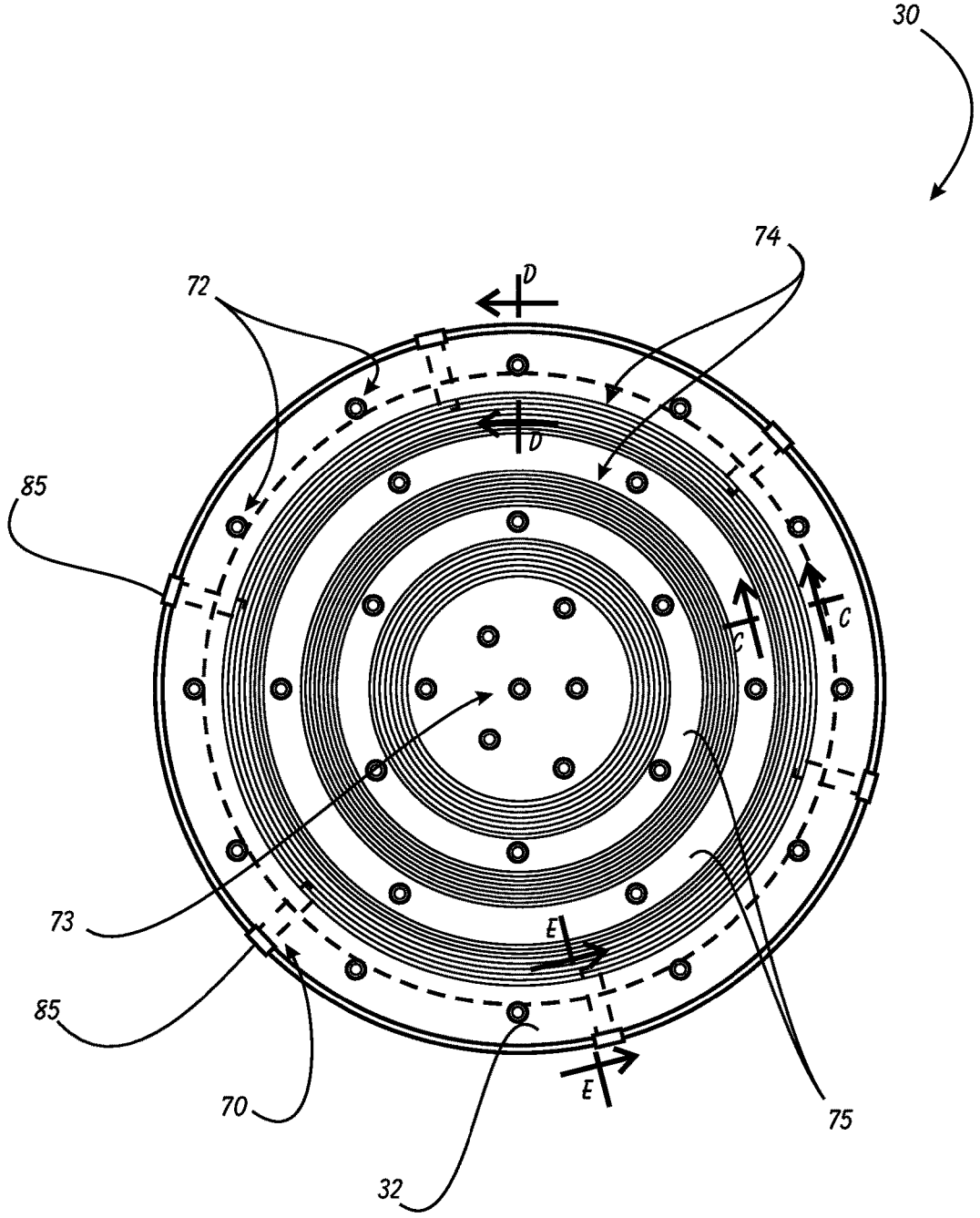
FIG. 7 is a top view of a second preferred embodiment of the present invention.

A second preferred embodiment of the attachment 30 of the present invention is depicted in FIG. 7, which is a top view of the present invention. The dome 32 of this version of the attachment 30 will be made from very thin aluminum (preferably in the range of 0.006 to 0.008 inches thick), and have a bright, shiny finish. Instead of standoff ridges (see previous figures), this version 30 has a plurality of standoff dimples 72 dispersed around the dome 32. It should be understood that certain (non-depicted) versions may have a variety of standoff protrusions (whether ridge-shaped, dimple-shaped, or other shapes)

This embodiment 30 is designed to ship flat, but allow the user to place it over the heater (see FIGS. 1 and 2), and then pull it down until it fits the shape of the heat shield (see FIGS. 1 and 2). This functionality is possible because the dome 32 is configured to have alternating uncrumple sections 74 and smooth sections 75. The standoff dimples 72 are formed in the smooth sections 75. the uncrumple sections 74 have concentric "waves" or creases formed in them in order to allow the user to re-shape the contour of the dome 32, as appropriate.

There is a center dimple 73 that is designed to be detachable from the dome member 32. Essentially, the central dimple 73 is a standoff dimple 72 that has a bottom that can be popped out. This design accommodates a wide variety of patio heaters (see FIGS. 1 and 2), since some heaters do not have a central attachment bolt (see FIG. 2), and some do. Whether or not a central attachment bolt exists on the heater (see FIGS. 1 and 2), the attachment 30 will be held (at least in part) to the heat shield (see FIG. 2) by a plurality of securing clips 70 that extend downwardly from the outer edge of the attachment 30, as discussed below in connection with the description of FIG. 10.

Figure 10:
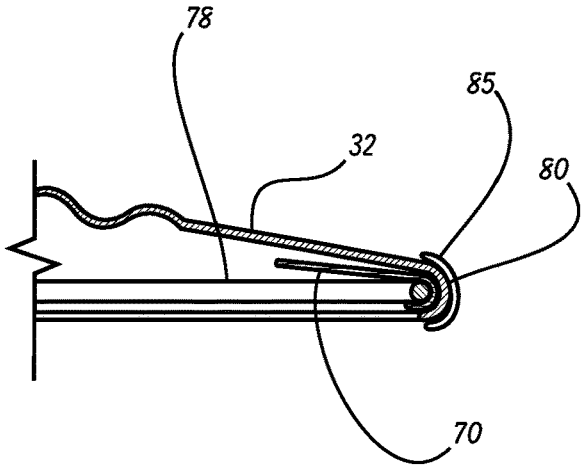
FIG. 10 is a partial cutaway side view of the outer edge area of the attachment of FIG. 7.

In this exemplary version 30, there are also reinforcing clips 85 attached to m the outer edge of the dome member 32 in ceder to provide additional reinforcing strength to each securing clip 70. FIG. 10 depicts these reinforcing clips 85 in a cutaway side view.

Figure 8:
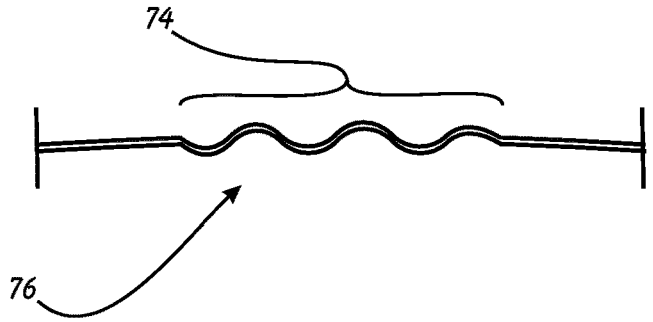
FIG. 8 is a partial cutaway side view of an uncrumple section of the attachment of FIG. 7.

FIG. 8 is a partial cutaway side view of an uncrumple section 74 of the attachment of FIG. 7. As shown, the section 74 is made of a series of circular, concentric creases 76 that will permit "stretching" and compression of the dome member (see FIG. 7) to fit a heat shield (see FIG. 2). The creases 76 could be made from smooth bends, as shown, or other shapes, as desired.

Figure 9:
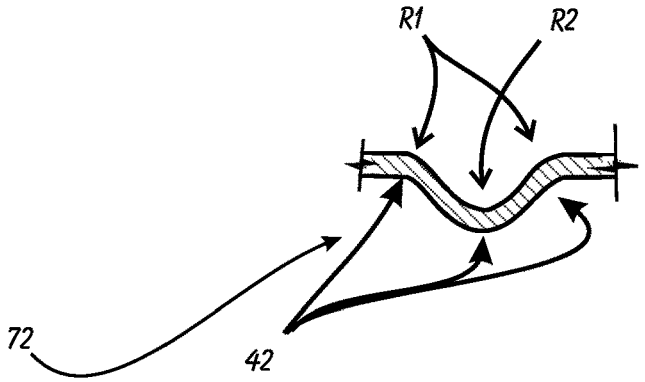
FIG. 9 is a partial cutaway side view of a standoff dimple of the attachment of FIG. 7.

FIG. 9 is a partial cutaway side view of a standoff dimple 72 of the attachment of FIG. 7. Essentially, the standoff dimples 72 have the same shape as the standoff ridges (see FIGS. 4 and 6), but in the form of a circle, rather than an elongate ridge. The dimples 72 will provide the same functionality as the ridges (see FIGS. 4 and 6).

Finally, FIG. 10 is a partial cutaway side view of the outer edge area of the attachment of FIG. 7. The attachment clips 70 are bendable metal strips extending inwardly from the outer edge of the dome member 32 and covered by a reinforcing clip to strengthen the attachment of the securing clips. In the depicted version, there is a peripheral ring stabilizer 78 captured within a fold 80 formed in the outer edge of the dome member 32. The ring stabilizer 78 serves to stiffen the dome member 32 so that it will be sufficiently durable and will not be affected by wind or other inclement weather.

The clips 70 are preferably captured within the foil 80 formed around the ring stabilizer 78 and reinforced with an external clip or ring. The clips 70 can be bent to fit the under surface of the heat shield (see FIGS. 1 and 2), to hold the attachment (see FIG. 7) securely in place.

Figure 11:
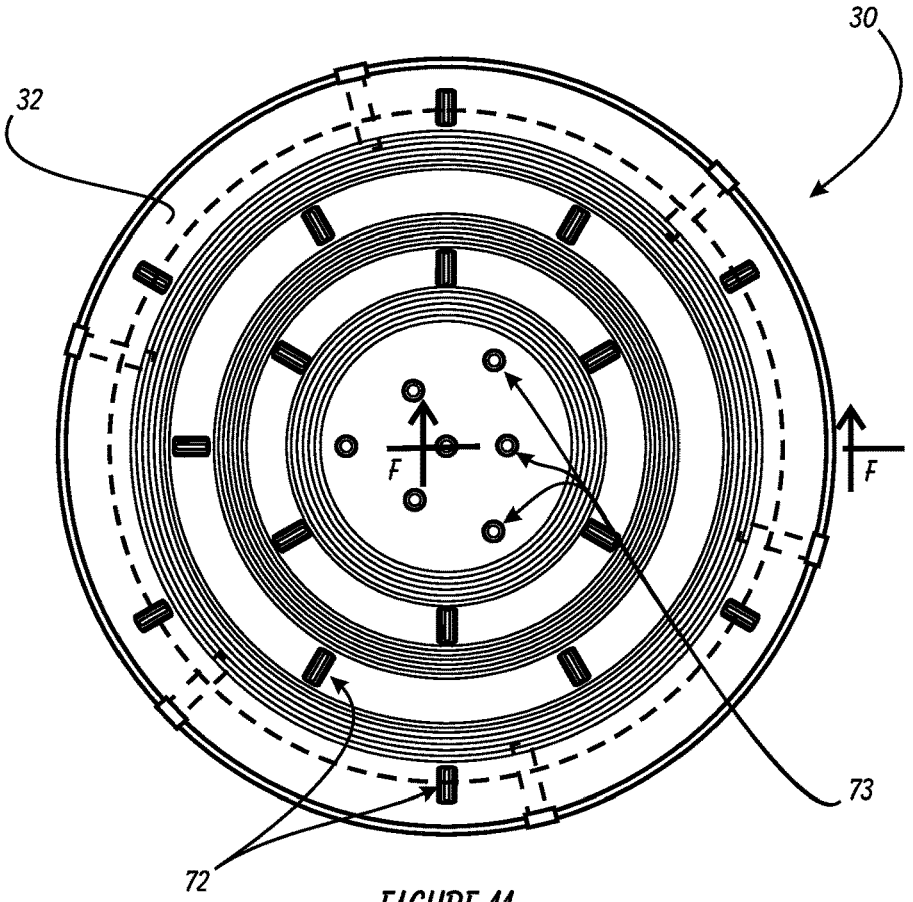
FIG. 11 is a top view of a third preferred embodiment of the present invention.
Figure 12:
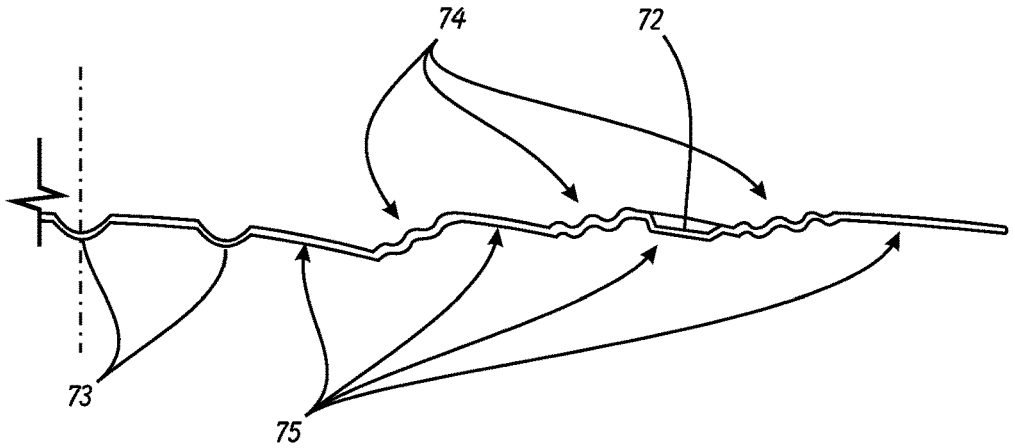
FIG. 12 is a partial cutaway side view of the dome member of the attachment of FIG. 11.

FIGS. 11 and 12 depict a third embodiment of the attachment 30 of the present invention. FIG. 11 is a top view of the third embodiment 30, and FIG. 12 is a partial cutaway side view of the dome member 32 of this version 30. Here, the dimples 72 are formed as sort of a hybrid between those depicted in FIG. 4, and those depicted in FIG. 8, that is to say that they are somewhat elongated, rather than circular. Also, the bottom of the dimples 72 will tend to have a somewhat flattened bottom in order to promote drainage of incident water and the like.

Another distinction in this version 30 is that there are a plurality of central dimples 73 at a variety of different distances from the center of the dome member 32. Each of these dimples 73 has an downwardly-protruding dome that can be perforated, if desired, in order to accommodate a mounting bolt passing therethrough (i.e. from the patio heater—see FIGS. 1 and 2).

Finally, and as depicted in FIG. 12, the smooth sections 75 of this version 30 are curved to the same contour as the smooth section at the center of the dome member 32. The uncrumple sections 74 will incline (as shown) when the dome member 32 is in a flattened condition, but will be contoured to fit the heat shield (see FIGS. 1 and 2) when the attachment 30 is attached to the patio heater (see FIGS. 1 and 2).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An attachment for patio heaters, the heaters having an upright stem, a burner unit extending upwardly therefrom and a heat shield defined by a perimeter edge positionable atop of the burner unit, the attachment comprising:

a dome member constructed from at least one thin sheet of aluminum, and defined by a plurality of ridges formed in said aluminum sheets so that they protrude downwardly therefrom, attachable atop said heat shield in generally juxtaposed position in spaced relation to the heat shield; and whereby said ridges rest on said heat shield to provide a separation distance between said heat shield and said dome member when said dome member is positioned atop said heat shield.

2. The attachment of claim 1, wherein said central portion of said dome member is defined by a plurality of standoff protrusions formed downwardly therefrom to form said ridges, said ridges protruding downwardly from said dome member by said separation distance.

3. The attachment of claim 1, wherein each said standoff protrusion is formed in said dome member deforming the material of said dome member to form a depression in a top surface of said dome member and a corresponding protrusion in a bottom surface of said dome member, each said depression having three bends in substantially parallel relative spaced relation.

4. The attachment of claim 3, wherein said dome member is made from at least one thin sheet of aluminum, said sheet being less than five millimeters in thickness.

5. The attachment of claim 4, wherein each said bend is defined by a 0.5 inch radius bend.

6. The attachment of claim 5, wherein said dome member is further defined by an aperture formed in the center of said dome member.

7. The attachment of claim 1, wherein said dome member is a generally circular perimeter shape and a curved central portion.

8. The attachment of claim 1, wherein said dome member has a generally rectangular perimeter shape and a pyramid-shaped central portion.

9. The attachment of claim 1, wherein said dome member has a generally oval perimeter shape and a curved central portion.

10. A patio heater, comprising:

an upright stem;

a burner unit extending upwardly from said stem;

a heat shield atop said burner unit; and a dome member in juxtaposed position above said heat shield, said dome member formed from a thin sheet of aluminum, and having at least one standoff protrusion formed in said thin sheet of aluminum and extending downwardly therefrom to contact said heat shield in order to create and maintain a gap between said heat shield and said dome member.

11. A combination patio heater and heat reflector, the combination comprising:

a patio heater, comprising an upright stem; a burner unit extending upwardly from said stem; and a heat shield atop said burner unit; and said heat reflector comprises a thin dome-shaped member formed from sheet aluminum material, said dome-shaped member located in juxtaposed position above said heat shield, said dome member having at least one standoff protrusion formed in said sheet of aluminum material and extending downwardly therefrom until it contacts said heat shield, in order to create and maintain a gap between said heat shield and said dome member.

12. The combination of claim 11, wherein said heat reflector is made from at least one thin sheet of aluminum, said sheet being less than five millimeters in thickness.

13. The combination of claim 12, whereby when said heat reflector is positioned atop the heat shield, said standoff protrusions contact the heat shield to provide a gap approximately equal to said separation distance between said dome member and the heat shield.

14. The combination of claim 13, wherein said heat reflector is further defined by an aperture formed in the center thereof.

15. The combination of claim 14, wherein each said standoff protrusion is formed in said heat reflector by deforming the material of said heat reflector to form a depression in a top surface of said heat reflector and a corresponding protrusion in a bottom surface of said heat reflector, each said depression having three bends in substantially parallel relative spaced relation.

16. The combination of claim 15, wherein each said bend is defined by a 0.5 inch radius bend.

17. The combination of claim 1, wherein said heat reflector is a generally circular perimeter shape and a curved, downwardly concave central portion.

18. The attachment of claim 4, wherein said dome member is defined by a plurality of uncrumple sections formed therein, said uncrumple sections comprising a plurality of concentric creases formed in said dome member.

19. The combination of claim 14, wherein said dome member is defined by a plurality of uncrumple sections formed therein, said uncrumple sections comprising a plurality of concentric creases formed in said dome member.

* * * * *